US008763772B2

(12) United States Patent
Buller et al.

(10) Patent No.: US 8,763,772 B2
(45) Date of Patent: Jul. 1, 2014

(54) STRAP HANDLE FOR A PIECE OF LUGGAGE THAT HAS BEEN MODIFIED TO HAVE THE STRAP HANDLE ADDED THEREON

(75) Inventors: Joshua Lynn Buller, New York, NY (US); Paul V. Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 454 days.

(21) Appl. No.: 12/806,639

(22) Filed: Aug. 18, 2010

(65) Prior Publication Data

US 2012/0006637 A1 Jan. 12, 2012

Related U.S. Application Data

(60) Provisional application No. 61/399,195, filed on Jul. 8, 2010.

(51) Int. Cl.
*A45C 13/26* (2006.01)

(52) U.S. Cl.
USPC ..... 190/115; 150/110; 16/410; 24/265 AL

(58) Field of Classification Search
USPC ..... 190/115–117; 16/114.1, 405–411; 150/110; 24/265 R, 265 A, 265 AL
See application file for complete search history.

(56) References Cited

U.S. PATENT DOCUMENTS

| | | | | | |
|---|---|---|---|---|---|
| 54,504 | A | * | 5/1866 | Cissna | 24/265 BC |
| 1,241,890 | A | * | 10/1917 | Schrader | 190/116 |
| 1,260,709 | A | * | 3/1918 | Reilly | 16/410 |
| 1,343,195 | A | | 6/1920 | Chilton | |
| 1,436,684 | A | * | 11/1922 | Rosenband | 16/406 |

(Continued)

FOREIGN PATENT DOCUMENTS

JP 200982247 * 4/2009

OTHER PUBLICATIONS

Form PCT/ISA/220, "Notification of Transmittal of the International Search Report and the Written Opinion . . . ", mailed Jan. 6, 2012 for PCT/US11/01353, (2 pgs).

(Continued)

*Primary Examiner* — Tri Mai
(74) *Attorney, Agent, or Firm* — Jon Fallon, Esq.; Michael P. Kochka, Esq.

(57) ABSTRACT

A strap handle for a piece of luggage that has been modified to have the strap handle added thereon. The strap handle includes a strap, and apparatus for having the strap handle added onto the piece of luggage. The apparatus sits within the piece of luggage. The strap engages into the apparatus.

12 Claims, 2 Drawing Sheets

(56) References Cited

U.S. PATENT DOCUMENTS

| | | | | | |
|---|---|---|---|---|---|
| 1,454,253 | A | * | 5/1923 | Rissman | 24/122.3 |
| 2,809,142 | A | * | 10/1957 | Sellen et al. | 33/770 |
| 3,103,267 | A | * | 9/1963 | Storey | 16/405 |
| 3,113,650 | A | * | 12/1963 | Szabo | 190/115 |
| 3,326,257 | A | * | 6/1967 | Gordon | 150/110 |
| 3,699,612 | A | | 10/1972 | Hanley et al. | |
| 3,704,647 | A | * | 12/1972 | Painaud | 411/375 |
| 4,047,263 | A | * | 9/1977 | Tietze | 16/444 |
| 4,261,448 | A | * | 4/1981 | Myers et al. | 190/115 |
| 4,264,083 | A | * | 4/1981 | Matthew et al. | 280/851 |
| 4,326,321 | A | | 4/1982 | Colognori | |
| 4,782,556 | A | | 11/1988 | Kim | |
| 5,440,783 | A | * | 8/1995 | Allardyce et al. | 16/110.1 |
| 5,771,537 | A | * | 6/1998 | Ho | 16/410 |
| 6,895,635 | B2 | * | 5/2005 | Tisol et al. | 16/110.1 |
| 7,234,888 | B2 | * | 6/2007 | Spaulding et al. | 403/388 |
| 7,712,590 | B1 | * | 5/2010 | Lee | 190/115 |
| 2003/0057045 | A1 | | 3/2003 | Chen | |

OTHER PUBLICATIONS

Form PCT/ISA/210, "International Search Report," mailed Jan. 6, 2012 for PCT/US11/01353, (2 pgs).

Form PCT/ISA/237, "Written Opinion of the International Searching Authority," mailed Jan. 6, 2012 for PCT/US11/01353, (4 pgs).

Supplementary European Search Report, mailed Mar. 25, 2014 for European Patent Application No. 11818471.2, 5 pgs.

* cited by examiner

STRAP HANDLE FOR A PIECE OF LUGGAGE THAT HAS BEEN MODIFIED TO HAVE THE STRAP HANDLE ADDED THEREON

1. CROSS REFERENCE TO RELATED APPLICATIONS

The instant non-provisional patent applications claims priority from provisional patent application No. 61/399,195 , filed on Jul. 8, 2010, for a STRAP HANDLE FOR A PIECE OF LUGGAGE THAT HAS BEEN MODIFIED TO HAVE THE STRAP HANDLE ADDED THEREON, and incorporated herein my reference thereto.

2. BACKGROUND OF THE INVENTION

A. Field of the Invention

An embodiment of the present invention relates to a strap handle for a piece of luggage, and more particularly, an embodiment of the present invention relates to a strap handle for a piece of luggage that has been modified to have the strap handle added thereon.

B. Description of the Prior Art

Numerous innovations for luggage handles have been provided in the prior art. Even though these innovations may be suitable for the specific individual purposes to which they address, however, they differ from an embodiment of the present invention in that they do not teach a strap handle for a piece of luggage that has been modified to have the strap handle added thereon.

3. SUMMARY OF THE INVENTION

Thus, an object of an embodiment of the present invention is to provide a strap handle for a piece of luggage that has been modified to have the strap handle added thereon, which avoids the disadvantages of the prior art.

Briefly stated, another object of an embodiment of the present invention is to provide a strap handle for a piece of luggage that has been modified to have the strap handle added thereon. The strap handle includes a strap, and apparatus for having the strap handle added onto the piece of luggage. The apparatus sits within the piece of luggage. The strap engages into the apparatus.

The novel features considered characteristic of an embodiment of the present invention are set forth in the appended claims. An embodiment of the present invention itself, however, both as to its construction and to its method of operation together with additional objects and advantages thereof will be best understood from the following description of a specific embodiment when read and understood in connection with the accompanying figures of the drawing.

4. BRIEF DESCRIPTION OF THE FIGURES OF THE DRAWING

The figures of the drawing are briefly described as follows.

5. LIST OF REFERENCE NUMERALS UTILIZED IN THE FIGURES OF THE DRAWING

Figure 1:
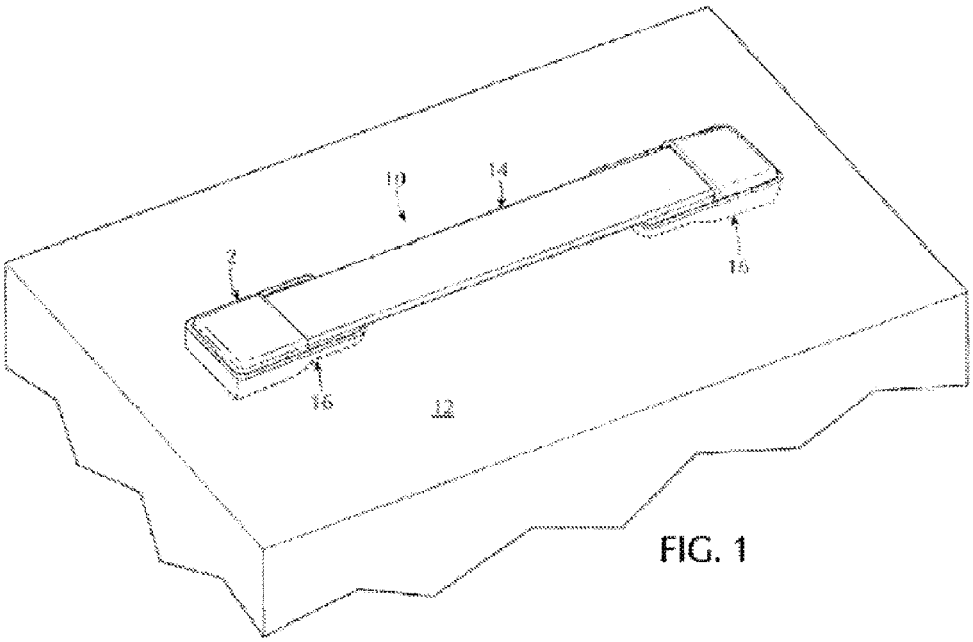
FIG. 1 is a diagrammatic perspective view of the strap handle of an embodiment of the present invention on a piece of luggage that has been modified to have the strap handle added thereon.

A. General.

10 strap handle of embodiment of present invention for piece of luggage 12 that has been modified to have strap handle 10 added thereon

12 piece of luggage

B. Overall Configuration of Strap Handle 10.

14 strap

16 apparatus for having strap handle 10 added onto piece of luggage 12

C. Specific Configuration of Strap 14 and Apparatus 16.

(1) Specific Configuration of Strap 14.

18 pair of ends of strap 14

(2) Specific Configuration of Apparatus 16.

28 pair of base plates of apparatus 16

30 pair of brackets of apparatus 16

34 pair of bearing caps of each bracket of pair of brackets 30 of apparatus 16

36 pair of tubes of apparatus 16

40 pair of pivot pins of apparatus 16

42 pair of end caps of apparatus 16

6. DETAILED DESCRIPTION OF THE PREFERRED EMBODIMENTS

A. General.

Referring now to the figures, in which like numerals indicate like parts, and particularly to FIG. 1, which is a diagrammatic perspective view of the strap handle of an embodiment of the present invention on a piece of luggage that has been modified to have the strap handle added thereon, the strap handle of an embodiment of the present invention is shown generally at 10 for a piece of luggage 12 that has been modified to have the strap handle 10 added thereon.

B. Overall Configuration of the Strap Handle 10.

The strap handle 10 comprises a strap 14, and apparatus 16 for having the strap handle 10 added onto the piece of luggage 12. The apparatus 16 sits within the piece of luggage 12. The strap 14 engages into the apparatus 16.

C. Specific Configuration of the Strap 14 and the Apparatus 16.

Figure 2:
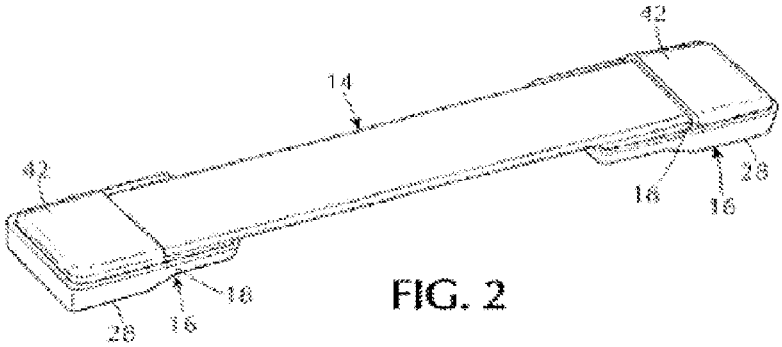
FIG. 2 is a diagrammatic perspective view of the strap handle of an embodiment of the present invention identified by ARROW 2 in FIG. 1.
Figure 3:
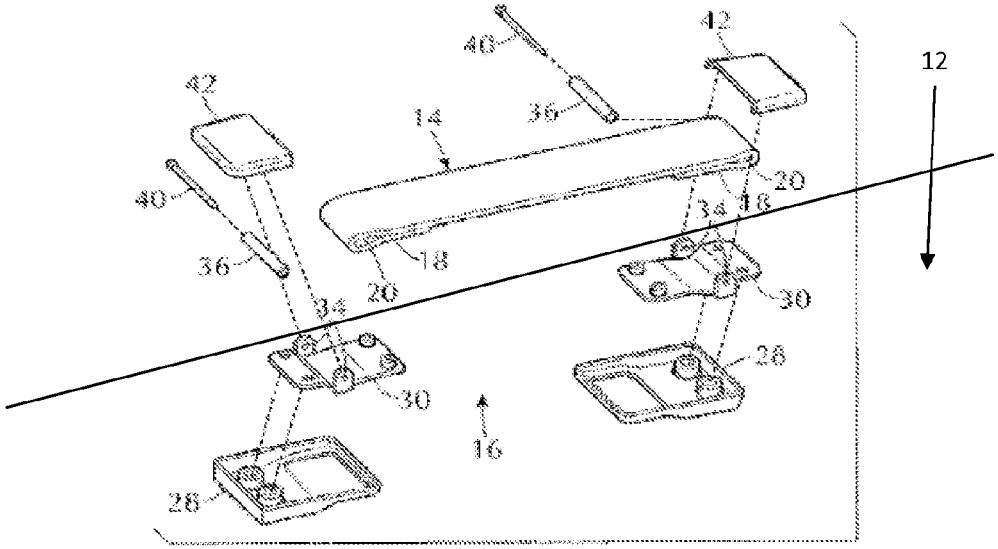
FIG. 3 is a reduced exploded perspective view of the strap handle of an embodiment of the present invention shown in FIG. 2.

The specific configuration of the strap 14 and the apparatus 16 can best be seen in FIGS. 2 and 3, which are, respectively, a diagrammatic perspective view of the strap handle of an embodiment of the present invention identified by ARROW 2 in FIG. 1, and a reduced exploded perspective view of the strap handle of an embodiment of the present invention shown in FIG. 2, and as such, will discussed with reference thereto.

(1) Specific Configuration of the Strap 14.

The strap 14 is slender, elongated, thin, and has a pair of ends 18. The pair of ends 18 of the strap 14 bend downwardly onto themselves to form a pair of sleeves 20, respectively.

(2) Specific Configuration of the Apparatus 16.

The apparatus 16 comprises a pair of base plates 28. The pair of base plates 28 of the apparatus 16 sit within the piece of luggage 12.

The apparatus 16 further comprises a pair of brackets 30. The pair of brackets 30 of the apparatus 16 sit in the pair of base plates 28 of the apparatus 16, respectively, and are within the piece of luggage 12.

Each bracket 30 of the apparatus 16 has a pair of bearing caps 34. The pair of bearing caps 34 of each bracket 30 of the apparatus 16 extend upwardly, and away from an associated base plate 28 of the apparatus 16.

The apparatus 16 further comprises a pair of tubes 36. The pair of tubes 36 of the apparatus 16 extend in the pair of sleeves 20 of the pair of ends 18 of the strap 14, respectively.

The apparatus 16 further comprises a pair of pivot pins 40. Each pivot pin 40 of the apparatus 16 extends through the pair of bearing caps 34 of an associated bracket 30 of the apparatus 16 and an associated tube 36 of the apparatus 16.

The apparatus 16 further comprises a pair of end caps 42. The pair of end caps 42 of the apparatus 16 cap off the pair of ends 18 of the strap 14, respectively, and are maintained thereat, by engaging the pair of brackets 30 of the apparatus 16, respectively.

D. Impressions.

It will be understood that each of the elements described above or two or more together may also find a useful application in other types of constructions differing from the types described above.

While an embodiment of the present invention has been illustrated and described as embodied in a strap handle for a piece of luggage that has been modified to have the strap handle added thereon, however, it is not limited to the details shown, since it will be understood that various omissions, modifications, substitutions, and changes in the forms and details of an embodiment of the present invention illustrated and its operation can be made by those skilled in the art without departing in any way from the spirit of an embodiment of the present invention.

Without further analysis the foregoing will so fully reveal the gist of an embodiment of the present invention that others can by applying current knowledge readily adapt it for various applications without omitting features that from the standpoint of prior art fairly constitute characteristics of the generic or specific aspects of an embodiment of the present invention.

The invention claimed is:

1. A strap handle for a piece of luggage, comprising:
a strap;
a pair of base plates adapted to sit within a surface of the piece of luggage;
a pair of brackets adapted to sit within the pair of base plates;
a pair of tubes;
wherein the strap engages into the pair of brackets;
wherein the pair of base plates and the pair of brackets sit within the piece of luggage;
wherein the strap has a pair of ends;
wherein the pair of ends of the strap bend downwardly onto themselves to form a pair of sleeves, respectively; and
wherein each bracket comprises a pair of bearing caps.

2. The handle of claim 1, wherein said strap is slender;
wherein said strap is elongated; and
wherein said strap is thin.

3. The handle of claim 1, wherein the pair of bearing caps of each bracket extend upwardly and away from an associated base plate.

4. The handle of claim 1, wherein the tubes extend in the pair of sleeves.

5. The handle of claim 1, further comprising a pair of pivot pins.

6. The handle of claim 5, wherein each pivot pin extends through the pair of bearing caps of an associated bracket; and
wherein each pivot pin extends through an associated tube.

7. The handle of claim 1, further comprising a pair of end caps.

8. The handle of claim 7, wherein the pair of end caps engage the pair of brackets.

9. A strap handle for a piece of luggage, comprising:
a strap;
a pair of base plates adapted to sit within a surface of the piece of luggage;
a pair of brackets adapted to sit within the pair of base plates;
a pair of end caps;
wherein the pair of end caps engage the pair of brackets;
wherein the strap engages into the pair of brackets;
wherein the pair of base plates and the pair of brackets sit within the piece of luggage; and
wherein each bracket comprises a pair of bearing caps.

10. The handle of claim 9, wherein the strap is slender;
wherein the strap is elongated; and
wherein the strap is thin.

11. The handle of claim 9, wherein the strap has a pair of ends; and
wherein the pair of ends of said strap bend downwardly onto themselves to form a pair of sleeves, respectively.

12. A strap handle for a piece of luggage, comprising:
a strap;
a pair of base plates adapted to sit within a surface of the piece of luggage;
a pair of brackets adapted to sit within the pair of base plates;
a pair of pivot pins;
wherein the strap engages into the pair of brackets;
wherein the pair of base plates and the pair of brackets sit within the piece of luggage;
wherein each bracket comprises a pair of bearing caps; and
wherein each pivot pin extends through the pair of bearing caps of an associated bracket.

* * * * *